US005352136A

United States Patent [19]

Chen

[11] Patent Number: 5,352,136

[45] Date of Patent: Oct. 4, 1994

[54] ELECTRICAL COUPLING DEVICE

[76] Inventor: Michael Chen, No. 11, Alley 16, Lane 337, Sec. 1, Ta-Tung Rd., Hsi-Chih Town, Taipei Hsien, Taiwan

[21] Appl. No.: 194,573

[22] Filed: Feb. 10, 1994

[51] Int. Cl.[5] ..... H01R 13/74

[52] U.S. Cl. ..... 439/719; 439/532

[58] Field of Search ..... 439/719, 532, 110, 121, 439/122, 210, 709, 712, 715

[56] References Cited

U.S. PATENT DOCUMENTS

| | | | |
|---|---|---|---|
| 4,273,966 | 6/1981 | Briggs, Jr. et al. | 439/719 |
| 4,824,403 | 4/1987 | De Luca et al. | 439/719 |
| 5,035,645 | 7/1991 | Siemon et al. | 439/719 |
| 5,083,941 | 1/1992 | Rodgers et al. | 439/532 |
| 5,129,842 | 7/1992 | Morgan et al. | 439/532 |

FOREIGN PATENT DOCUMENTS

| | | | |
|---|---|---|---|
| 0781246 | 8/1957 | United Kingdom | 439/719 |
| 2147465 | 5/1985 | United Kingdom | 439/719 |

*Primary Examiner*—P. Austin Bradley
*Assistant Examiner*—Erik R. Puknys
*Attorney, Agent, or Firm*—Bacon & Thomas

[57] ABSTRACT

An electrical coupling device includes at least one wiring block, and at least one pair of supporting blocks respectively fastened to the at least one wiring block at two opposite ends to support them inside an electrical junction box, wherein each wiring block has two rows of upright posts with retaining notches and T-holes; each supporting block has two mounting members respectively hooked in the retaining notches on the two opposite outer upright posts at either end of the wiring block to stop the wiring block from being moved horizontally, and two T-rods respectively fastened to the T-holes on the two intermediate upright posts at the same end to stop the wiring block from be moved vertically.

1 Claim, 6 Drawing Sheets

ELECTRICAL COUPLING DEVICE

BACKGROUND OF THE INVENTION

The present invention relates to an electrical coupling device for use in an electrical junction box to connect electrical wires together.

Various electrical coupling devices are known and widely used to connect electrical wires in an electrical junction box or panel. FIG. 1 shows an electrical coupling device according to the prior art, which is generally comprised of a wiring block directly having unitary stands fastened to the electrical junction box or panel and having index strips at two opposite sides, and a plurality of connecting block assemblies respectively fastened to the index strips to join conductors. This electrical coupling device is not satisfactory in function because it is not expansible. For example, if the electrical coupling device comprises four sets of connecting block assemblies and each connecting block assembly is made to couple 25 sets of electrical wires, the electrical coupling device can then couple 100 sets of electrical wires maximum. When there are more than 101 sets of electrical wires to be matched, at least two electrical coupling devices must be used. If there are only few sets of electrical wires to be matched, much vacant spaces will be left for no use. Another drawback of this structure of electrical coupling device is that the electrical coupling device cannot be conveniently dismantled from the electrical junction box or panel when installed, causing the maintenance and inspection works difficult to perform.

There is also known a detachable structure of electrical coupling device which, as shown in FIG. 2, is generally comprised of a wiring block and two supporting block fastened to the two opposite ends of the wiring block at the bottom. The wiring block has two rows of upright posts with mounting holes. The supporting blocks have a respective pair of hooked members at the top. When connected, the hooked members engage the two opposite outer upright posts at either end of the wiring block by hooked joints. This structure of electrical coupling device permits the wiring blocks to be removed from the supporting blocks when the hooked members are released from the respective upright posts, and therefore the maintenance and inspection works can be conveniently performed. However, this structure of electrical coupling device still has drawbacks. When two wiring blocks are connected in parallel by two supporting blocks, the two hooked members of either supporting blocks must be respectively fastened to one upright post on either wiring block at either end. This arrangement cannot keep the wiring blocks stably maintained in place, and the hooked members may disconnect from the wiring blocks easily.

SUMMARY OF THE INVENTION

The present invention has been accomplished under the aforesaid circumstances. It is therefore an object of the present invention to provide an electrical coupling device which is detachable so that it can be conveniently dismantled from the electrical junction box or panel after its installation for performing a maintenance or inspection work. It is another object of the present invention to provide an electrical coupling device which is expansible. To achieve these objects, there is provided an electrical coupling device which comprises at least one wiring block, and at least one pair of supporting blocks respectively fastened to an electrical junction box or panel to support the at least one wiring block, wherein each wiring block has two rows of upright posts with retaining notches and T-holes; each supporting block has two mounting members respectively hooked in the retaining notches on the two opposite outer upright posts at either end of the wiring block to stop the wiring block from being moved horizontally, and two T-rods respectively fastened to the T-holes on the two intermediate upright posts at the same end to stop the wiring block from be moved vertically. By releasing the mounting members and the T-rods from the respective retaining notches and the respective T-holes, the at least one wiring block can be removed from the at least one pair of supporting blocks for performing the maintenance and inspection works.

DETAILED DESCRIPTION OF THE PREFERRED EMBODIMENT

Figure 1:
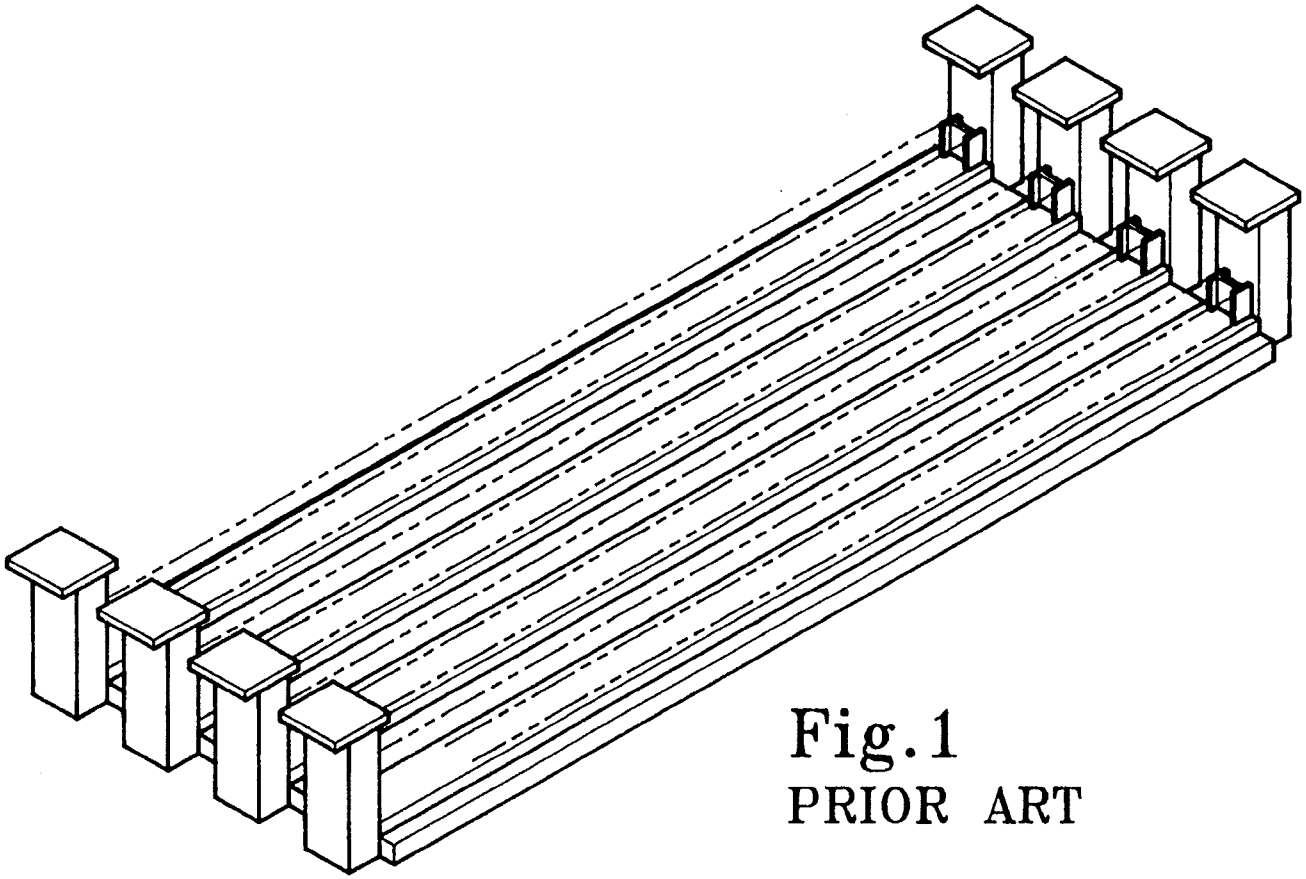
Fig. 1 PRIOR ART
FIG. 1 is shows an electrical coupling device according to the prior art.
Figures 2A, 2B:
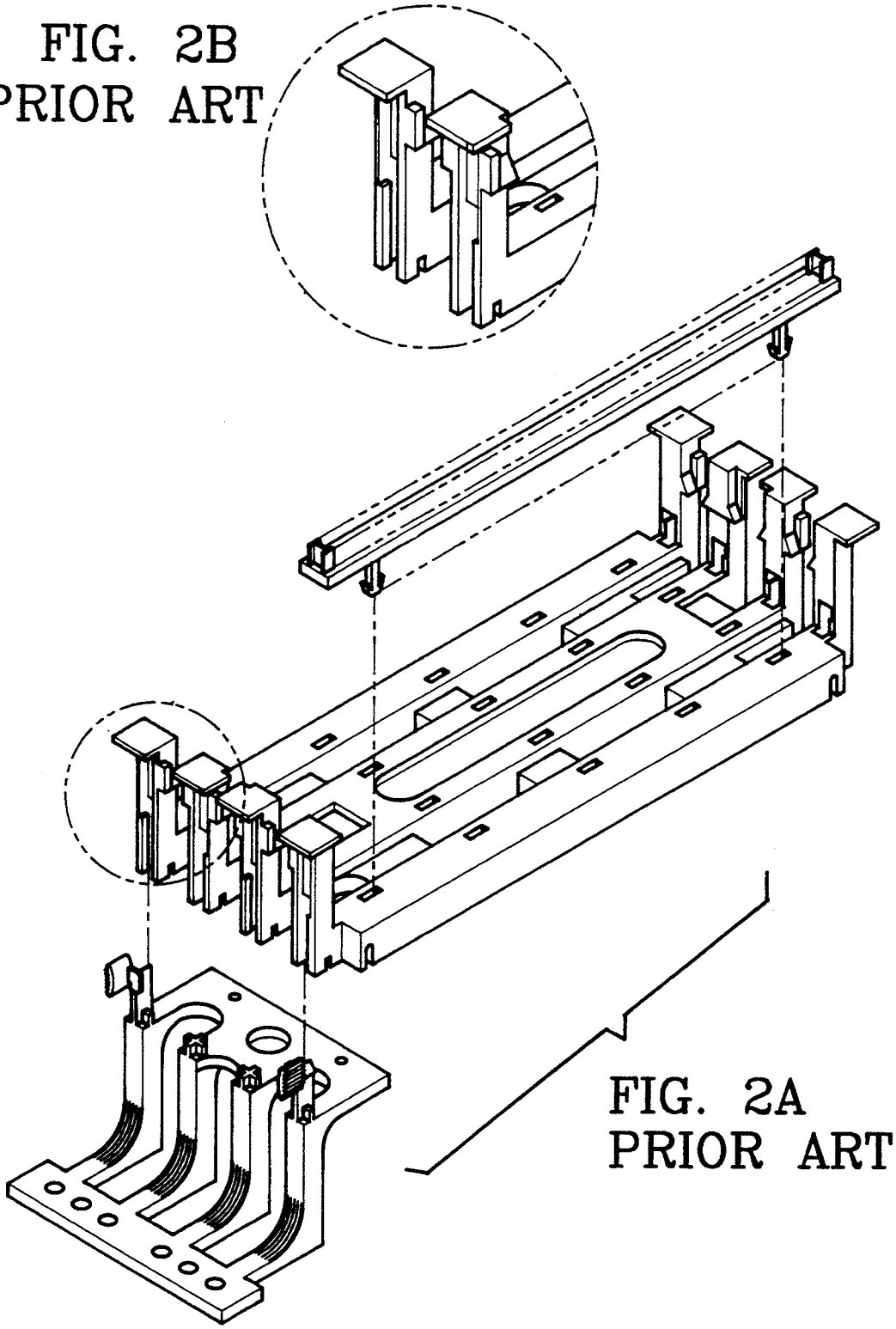
FIG. 2B PRIOR ART
FIG. 2A PRIOR ART
FIG. 2 is an exploded view of another structure of electrical coupling device according to the prior art.
Figures 3A, 3B:
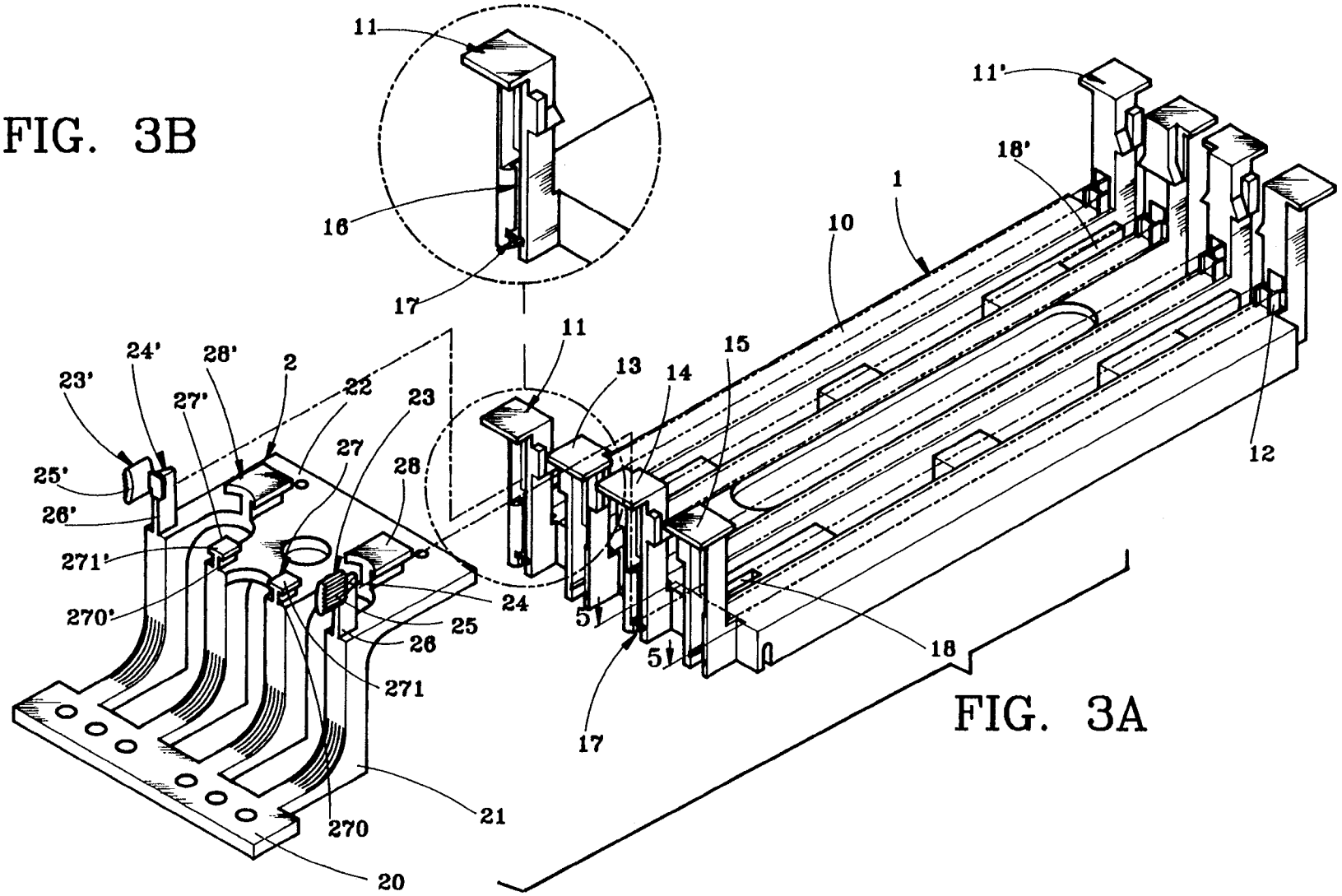
FIG. 3 is an exploded view of an electrical coupling device according to the preferred embodiment of the present invention.

Referring to FIG. 3, an electrical coupling device in accordance with the present invention is generally comprised of at least one wiring block 1, and a plurality of supporting blocks 2 respectively and detachably fastened to the two opposite ends of each wiring block 1 at the bottom.

Figure 4:
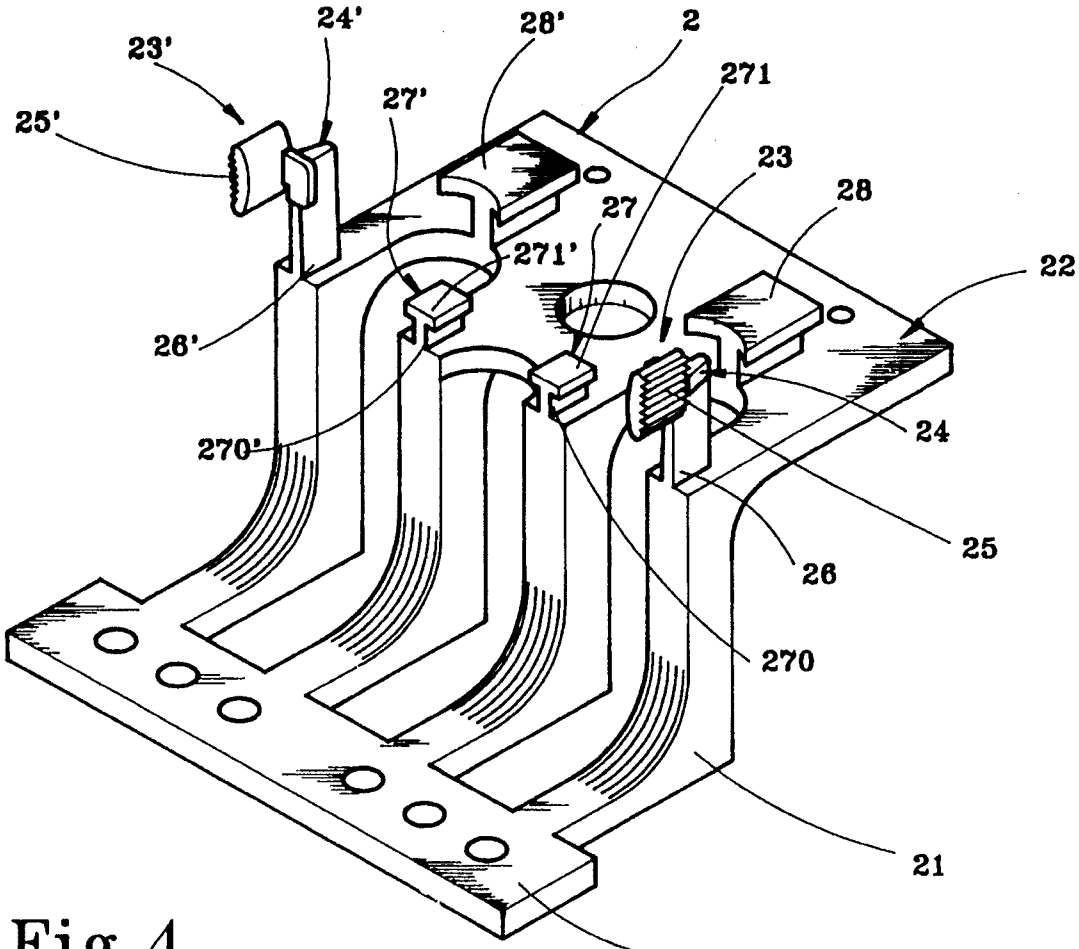
FIG. 4 is an elevational view of the supporting block shown in FIG. 3.
Figure 5:
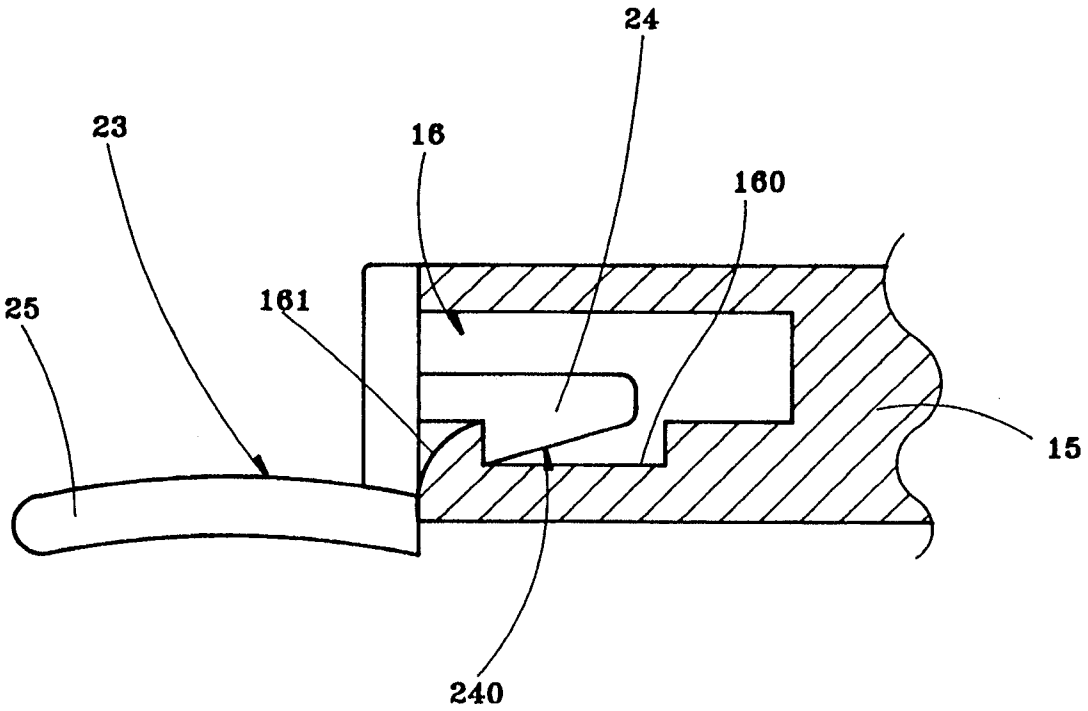
FIG. 5 is a sectional view in an enlarged scale showing the hook of one mounting member of the supporting block shown in FIG. 3 hooked in the respective retaining notch.

Referring to FIGS. 4 and 5 and FIG. 3 again, the wiring block 1 comprises a flat, rectangular base panel 10 disposed in horizontal, two opposite rows of upright posts 11;11' vertically disposed and transversely aligned at two opposite ends of the base panel 10, and a plurality of transversely spaced electrical connecting strips 12 longitudinally installed in the base panel 10 between the upright posts 11;11'.

The upright posts 11;13;14;15 at either end of the base panel 10 are equally spaced from one another. The total number of the upright posts at either end of the base panel 10 is an appropriate number so that a plurality of the aforesaid structure of wiring blocks and supporting blocks can be connected in parallel to extend the size (capacity) of the electrical coupling device. Each upright post comprises a mounting hole 16 axially disposed at an outer side (in direction reversed to the wiring block).

The supporting block 2 comprises a horizontal mounting plate 20 at the bottom for mounting on an electrical junction box or the like, a plurality of equally spaced upright legs 21 raised from the mounting plate 20 at the same side, and a horizontal bearing plate 22 connected to the upright legs 21 at the top for supporting the wiring block 1. The width of the horizontal bearing plate 22 of the supporting block 2 is equal to that of the wiring block 1. The horizontal bearing plate 22 comprises two opposed mounting members 23;23' at the top, wherein each mounting member comprises a neck 26 or 26' raised from the horizontal bearing plate 22 and engaged into the mounting hole 16 on the corresponding upright post 11 or 11' at either end of the base panel 10, a hook 24 or 24' projected from the neck 26 or 26' and hooked in a transverse retaining notch 160 inside the respective mounting hole 16 (see FIG. 5), and a finger strip 25 or 25' extended from the neck 26 or 26'. As illustrated in FIG. 5, when the supporting block 2 is connected to either end of the wiring block 1, the bottom sloping edge 240 of the hook 24 passes over a smoothly curved surface 161 being disposed at the front of the retaining notch 160 and then engages into the retaining notch 160, and therefore the hook 24 becomes hooked in the retaining notch 160. Simply by pressing the finger strip 25 downwards to deform the springy neck 26, the nook 24 is forced to disengage from the retaining notch 160, and therefore the supporting block 2 is detached from the wiring block 1. The horizontal bearing plate 22 also comprises two rear T-rods 27 or 27' spaced between the mounting members 23;23' and respectively engaged into the mounting hole 16 on either of the two intermediate upright posts 13;14 at either end of the base panel 10. The rear T-rod 27 or 27' comprises a horizontal head 271 and a vertical rod section 270 perpendicularly extended from the horizontal head 271 in the middle. Inside the mounting hole 16, there is a T-hole 17 for receiving the rear T-rod 27 or 27'. The aforesaid hooks 24;24' prevent the wiring block 1 and the supporting block 2 from moved apart horizontally; the aforesaid rear T-rods 27;27' prevent the wiring block 1 and the supporting blocks from moved apart vertically. The horizontal bearing plate 22 further comprises two front T-rods 28 or 28' which engage into a respective retaining hole 18 or 18' on the base panel 10 to stop the base panel 10 from being moved upwards from the supporting block 2.

Figure 6:
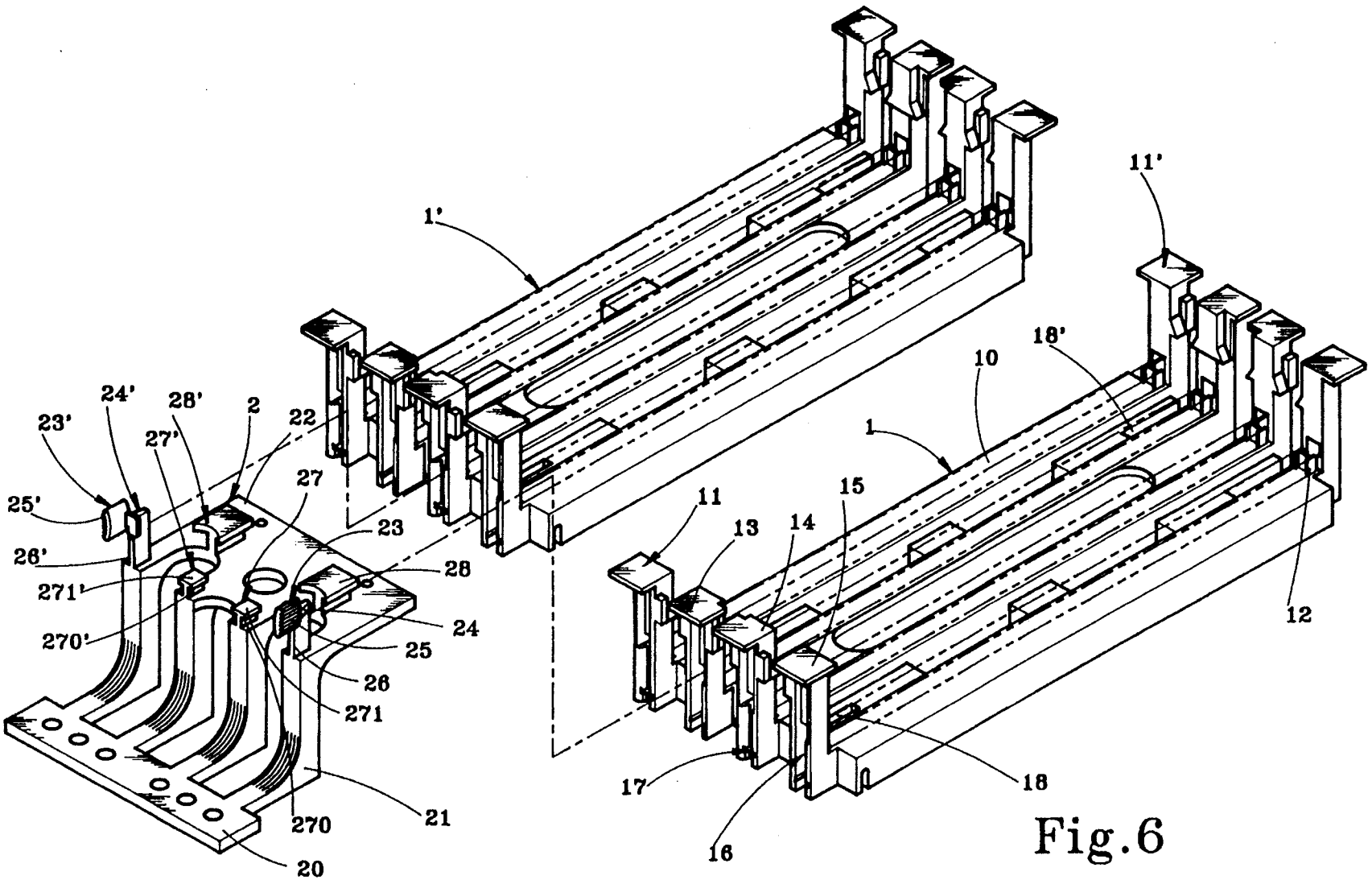
FIG. 6 shows an application of the present invention to couple two wiring blocks together.

According to the aforesaid statement, the supporting block 2 can be conveniently fastened to or removed from the wiring block 1. Because each upright post 11 has a mounting hole 16 for mounting the supporting block 2, two wiring blocks 1;1' can be joined in parallel by two supporting blocks 2 (See FIG. 6).

In the aforesaid embodiment, the wiring block 1 has four upright posts at either end 11;13;14;15. When only one wiring block 1 is used, the two mounting members 23;23' of the supporting block 2 engage the two outer upright posts 11;15 permitting the two rear T-rods 27;27' to be fastened to the two intermediate upright post 13;14. When two wiring blocks 1;1' are jointed in parallel, the two mounting members 23;23' respectively engage the second upright post 13 of each wiring block 1 or 1', and the rear T-rods 27;27' are respectively fastened to the first upright post 11 of each wiring block 1 or 1'. Therefore, the present invention allows the electrical coupling device to be conveniently expanded in size.

I claim:

1. An electrical coupling device comprising at least one wiring block, and at least one pair of supporting blocks respectively fastened to said at least one wiring block at two opposite ends to support said at least one wiring block inside an electrical junction box, wherein each wiring block comprises a flat, rectangular base panel horizontally disposed and having pairs of opposed retaining holes bilaterally disposed near two opposite ends thereof, two opposite rows of upright posts vertically disposed and transversely aligned at either end of said base panel, and a plurality of transversely spaced electrical connecting strips longitudinally installed in said base panel between the two rows of upright posts, each upright post having a mounting hole, a T-hole disposed inside the mounting hole at the bottom, and a retaining notch disposed inside the mounting hole at the top;

each supporting block comprises a horizontal mounting plate at the bottom for mounting on the electrical junction box, a plurality of equally spaced upright legs raised from said mounting plate, and a horizontal bearing plate connected to said upright legs at the top for supporting said wiring block, said horizontal bearing plate comprising two opposed mounting members bilaterally disposed at the top for fastening to either upright post at either end of said base panel, two rear T-rods spaced between said mounting members for engaging into the mounting hole on either upright post at either end of said base panel to retain the respective supporting block to said wiring block, and two front T-rods for engaging into either retaining hole on said base panel at either end, each mounting member comprising a neck raised from said horizontal bearing plate for inserting into the mounting hole on the corresponding upright post, a hook projected from the neck for hooking in the retaining notch on the respective upright post, and a finger strip extended from the neck for bending the neck in releasing said hook from the retaining notch.

* * * * *